US005528131A

United States Patent [19]

Marty et al.

[11] Patent Number: 5,528,131

[45] Date of Patent: Jun. 18, 1996

[54] CONTROLLED ELECTRIC POWER SWITCH AND PROCESS FOR SWITCHING AN ELECTRIC POWER CIRCUIT

[75] Inventors: Christian Marty, Avrille les Ponceaux; Jean-Claude Keryjaouen, Maisons-Alfort, both of France

[73] Assignee: SGS-Thomson Microelectronics S.A., Pouilly, France

[21] Appl. No.: 124,942

[22] Filed: Sep. 21, 1993

[30] Foreign Application Priority Data

Sep. 23, 1992 [FR] France ..... 92 11337

[51] Int. Cl.[6] ..... G05F 1/44

[52] U.S. Cl. ..... 323/901; 323/238; 361/3

[58] Field of Search ..... 361/3, 8, 13; 323/237, 323/238, 901

[56] References Cited

U.S. PATENT DOCUMENTS 4,445,183 4/1984 McCollun et al. ..... 361/3 X 4,500,934 2/1985 Kinsinger ..... 361/3

4,725,911 2/1988 Dieppedalle et al. ..... 361/8

FOREIGN PATENT DOCUMENTS

A-0218491 4/1987 European Pat. Off. ..... H01H 9/54

A-2525386 10/1983 France ..... H01H 9/56

A-2185856 7/1987 United Kingdom ..... H01H 9/54

*Primary Examiner*—Peter S. Wong

*Assistant Examiner*—Y. Jessica Han

*Attorney, Agent, or Firm*—David M. Driscoll; James H. Morris

[57] ABSTRACT

This invention relates to an electric switch intended to be placed in an electric power circuit, said switch being responsive to a control signal. The switch comprises a semiconductor switch, an electromechanical switch and a signal processor. The electromechanical switch is connected in parallel to the semiconductor switch. The signal processor receives the control signal and outputs a command signal for controlling the semiconductor switch and the electromechanical switch. The invention also relates to a process for switching an electric power circuit.

23 Claims, 2 Drawing Sheets

CONTROLLED ELECTRIC POWER SWITCH AND PROCESS FOR SWITCHING AN ELECTRIC POWER CIRCUIT

BACKGROUND OF THE INVENTION

1. Field of the Invention

This invention relates to a controlled electric power switch and a process for switching an electric power circuit.

2. Discussion of the Related Art

The term power switch will be used here to denote a switch which is intended to be placed in an electric power circuit. Such power switches are widely used, and ways of improving them and reducing their cost have been sought for many years.

There are two main categories of known controlled electric power switches: electromechanical switches and semiconductor switches.

Electromechanical switches are the oldest, but are still very widely used. Their drawbacks are their size, which is a function of the electric power transmitted by the line in which they are placed, and wear of the switch, which is partly due to an arcing phenomina occurring when the switch is opened or closed.

Semi-conductor switches are static which means that wear is quite limited. However, existing technologies only make it possible to fabricate semiconductors that present a relatively large passing state (switch is closed) voltage drop, large enough to cause the switch to heat up and result in energy losses whenever the circuit is closed.

An object of this invention is a controlled electric power switch without the drawbacks of electromechanical switches or those of semiconductor switches.

SUMMARY OF THE INVENTION

The present invention concerns an electric power switch, intended to be placed in an electric poser circuit, said switch being opened and closed in response to a command signal. The electric power switch comprises a semiconductor switch, an electromechanical switch and a signal processor.

The electromechanical switch is connected in parallel across the semiconductor switch. The command signal is received by the signal processor and output to the semiconductor switch and the electromechanical switch for controlling the switches.

Different embodiments of the present invention have the following characteristics in all technically possible combinations:

When the power switch is closed, first the semiconductor switch is closed followed by the electromechanical switch. When the power switch is opened, first the electromechanical switch is opened followed by the semiconductor switch.

The power switch may be placed in a main circuit carrying alternating current and the signal processor will analyze the wave form of the voltage in the power circuit at the terminals of the power switch, and will close or open the electromechanical switch when the value of the voltage is in a target voltage range.

The semiconductor switch can be a triac, or a group of thyristors, or a group of Isolation Gate Bipolar Transistor type components. The electromechanical switch can be a mercury-contact relay. The signal processor is powered from the main circuit via a low-voltage regulator. The signal processor may be remotely controlled. The command signal received by the signal processor is output by the main circuit. The command signal is first received and operated on by a modem which sends it to the signal processor, wherein the modem is connected in parallel to the main circuit. The signal processor also generates and sends a signal in return to indicate that the command has been executed. The return signal is received and sent by the modem signal to the main circuit.

The present invention also relates to a method for switching an electric power circuit comprising a semiconductor switch and an electromechanical switch which are connected in parallel. When the power switch is to be closed, first the semiconductor switch is closed followed by the electromechanical switch. Inversely, when the power switch is to be opened, first the electromechanical switch is opened followed by the semiconductor switch.

In a preferred embodiment, this switching process is applied to a circuit carrying alternating current, the closing and opening of the electromechanical switch occurring when the value of the voltage in the circuit across the terminals of the switch is in a target voltage range.

BRIEF DESCRIPTION OF THE DRAWINGS

The following description of a particular embodiment of the invention is purely illustrative and non-limiting. It should be read in conjunction with the accompanying drawings, in which.

DETAILED DESCRIPTION

Figure 1:
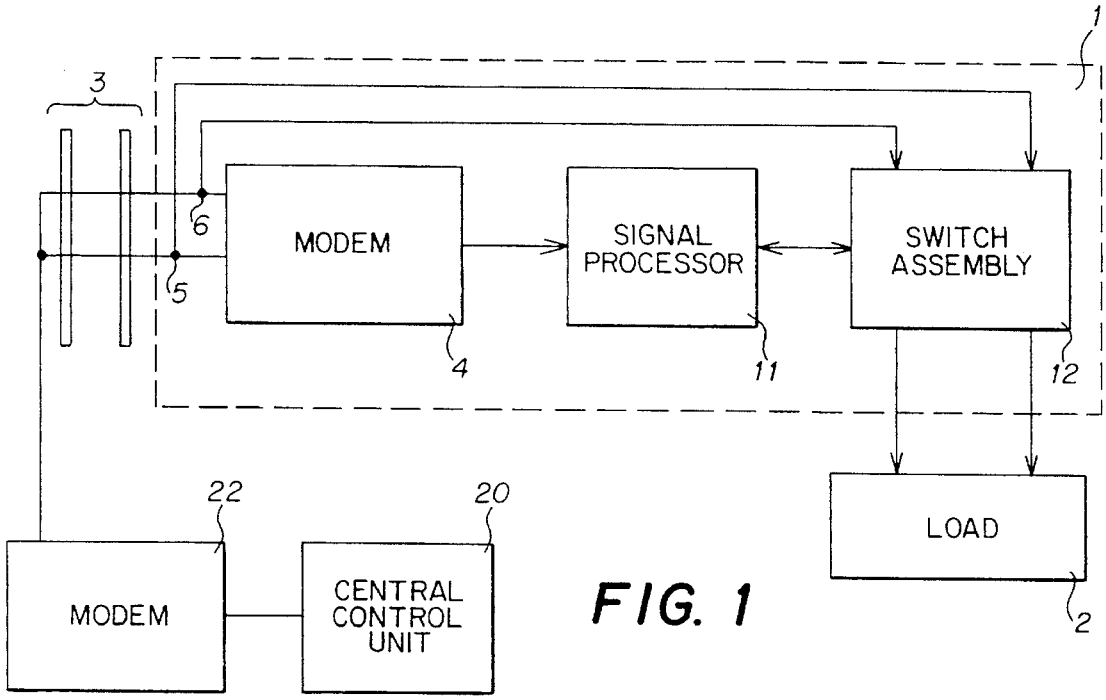
FIG. 1 is a block diagram showing where the power switch is placed in a main circuit.

Referring to FIG. 1, power switch 1 is placed between a load 2 and a main power circuit 3. In accordance with convention, when power switch 1 is closed, load 2 is under tension wherein power is being supplied to the load from the main power circuit 3. Conversely, when switch 1 is open, load 2 is disconnected from the main circuit 3. the opening and closing of power switch 1 are advantageously commanded remotely, for example by a signal flowing through power circuit 3 on a carrier signal and demodulated by the modem 4. Alternately, a local command can be provided.

A signal processor 11 incorporated in power switch 1 receives the command signal from modem 4 and commands switch assembly 12 interposed between main circuit 3, to which it is connected by terminals 5 and 6, and load 2. The modem 4 is also connected to terminals 5 and 6, and receives via these same terminals the modulated-command signal originating from power circuit 3.

Signal processor 11 can also send a return signal indicating the open or closed state of switch 1, or even indicating the execution of a command. This return signal, sent by the signal processor, is sent by modem 4 through power circuit 3. A central control unit 20 is connected to the signal processor 11 via a second modem 22 linked to the main circuit.

Figure 2:
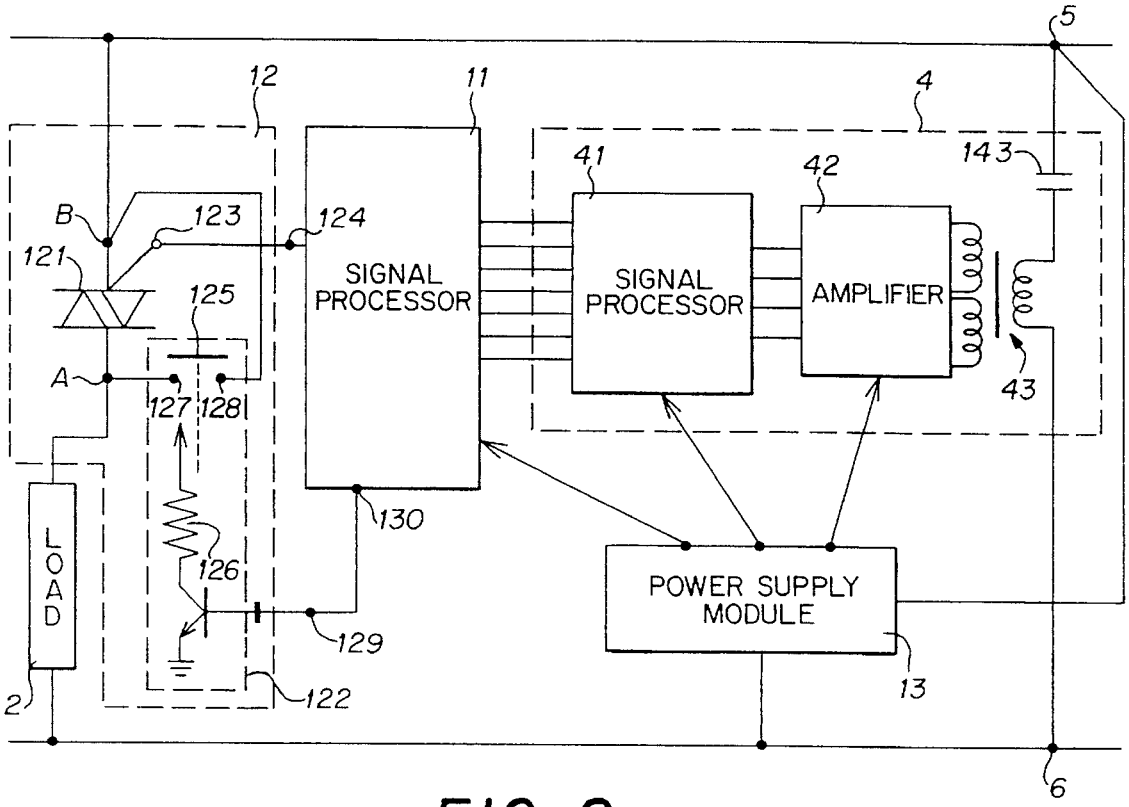
FIG. 2 is a schematic diagram identifying the different elements that make up the power switch.

Switch 1 is illustrated in greater detail in FIG. 2 which shows, by means of the same numbers as used in FIG. 1, terminals 5 and 6 of the main circuit, modem 4, signal processor 11, switch assembly 12 and load 2.

Switch assembly 12 comprises a semiconductor switch 121 and an electromechanical switch 122 linked to each other at terminals A and B in such a way as to be parallel connected.

The semiconductor switch is preferably a triac, with a control terminal 123 connected to an output 124 of signal processor 11. This switch can also take the form of a group of thyristors, or a group of Isolation Gate Bipolar Transistor type components.

Electromechanical switch 122 comprises a coil 126 which, when energized, displaces contact 125 which is then able to link terminals 127 and 128. This electromechanical switch 122 can also be a bistable switch. The bistable electromechanical switch comprises a permanent magnet core and two coils. Applying power to one or the other of these coils determines the direction of magnetization of the core. Control terminal 129 of the electromechanical switch is connected to output 130 of signal processor 11.

Modem 4 comprises a signal processor 41, an operational amplifier 42 and a transformer 43.

The primary coil of transformer 43 is connected to terminals 5 and 6 of the main power circuit, with a capacitor 143 being included to stop transmission of parasitic interference. The secondary coils of the transformer are connected to the operational amplifier which is in turn connected to signal processor 41 that sends signals to or receives signals from signal processor 11. A power supply module 13, connected to terminals 5 and 6, furnishes the power that signal processor 41, operational amplifier 42 and signal processor 11 require in order to operate.

Figure 3:
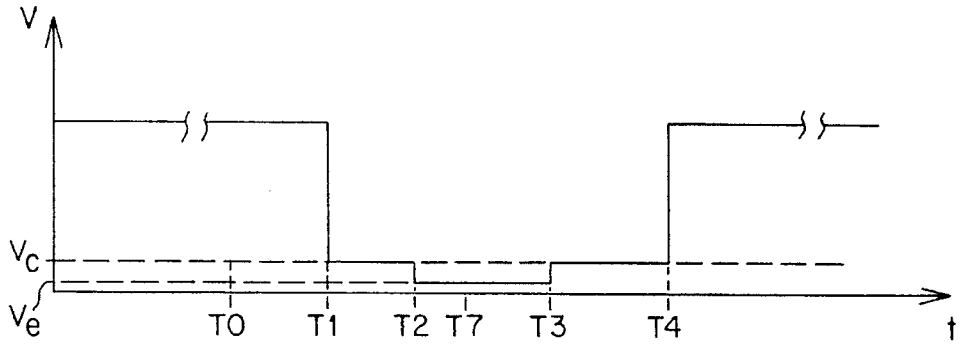
FIG. 3 is a timing diagram illustrating the operation of the power switch when it is opened and closed.

The operation of the power switch will now be described with reference to FIG. 3 in which the Y-axis represents the potential difference V=VB–VA present on the terminals of switch assembly 12, and the X-axis indicates the time. At the $T_0$, the power switch is open, the potential difference V is at a maximum and corresponds to the voltage supplied by main circuit 3. At $T_0$, modem 4 receives a modulated command signal to close the switch, demodulates the signal, and sends the command signal to the processor 11. The signal processor 11 first of all proceeds to close the semiconductor switch within time interval $T_1$. The potential difference $V_B-V_A$ is then considerably reduced to the fall voltage $V_C$ of the semiconductor switch.

Shortly afterwards, signal processor 11 commands the closing of the electromechanical switch 122. Since the fall voltage $V_E$ of electromechanical switch 122 is substantially lower than the fall voltage $V_C$ of semiconductor switch 121, the potential difference $V=V_B-V_A$ is reduced to the value $V_e$. It remains at this value throughout the period the power switch is closed (situation at $T_7$).

An opening of the power switch is achieved in symmetrical fashion when signal processor 11 receives the corresponding command signal via modem 4. At $T_7$, the switch is closed, the signal processor first of all outputs the commands signal to open the electromechanical switch 122 at $T_3$. This causes voltage $V=V_b-V_A$ to rise from its minimum value $V_e$ to the value $V_c$ equal to the fall voltage of semiconductor switch 121. Semiconductor switch 121 is then opened at time $T_4$, bringing voltage $V=V_B-V_A$ to its maximum value.

An advantage of the device can now be understood to be that whenever electromechanical switch 122 is opened or closed, it is only subjected to, at its terminals A and B, a potential difference equal to the fall voltage $V_c$ of the semiconductor switch. This therefore makes it possible to use a compact electromechanical switch and to limit wear of the electromechanical switch. With respect to the semiconductor switch 121, the supply current supplied to the load 2 only flows through it during the intervals between $T_1$ and $T_2$ on the one hand, and $T_3$ and $T_4$ on the other. The negative effects due to its being heated by a heavy current flowing though the switch are therefore reduced to these time periods and therefore virtually eliminated. Preferably, the time interval between $T_2$ and $T_1$ on the one hand, and $T_4$ and and $T_3$ on the other, is very brief, possibly corresponding to only a few oscillations of the supply voltage output by circuit 3.

Figure 4:
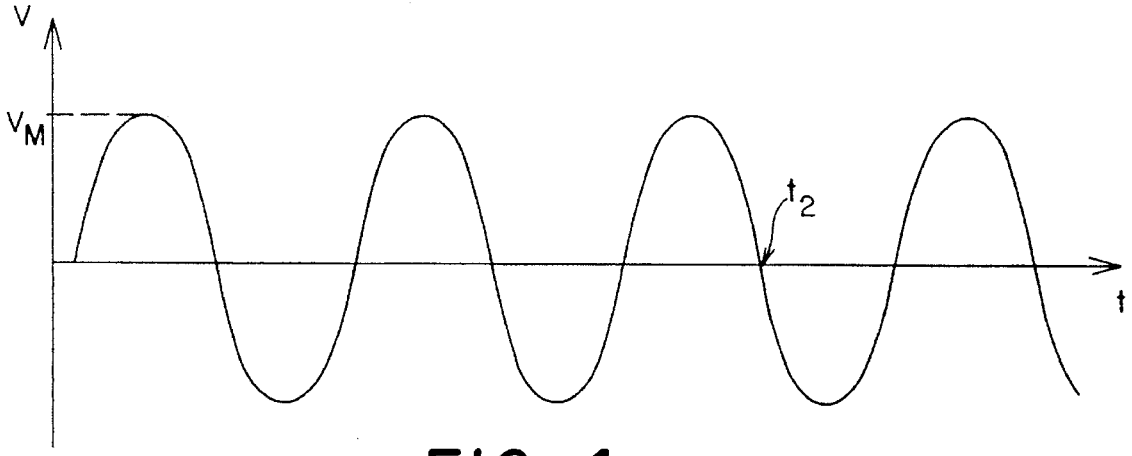
FIGS. 4 and 5 are illustrations of the wave form of the voltage in the main circuit and the switching instants of the electromechanical switch in a preferred embodiment.
Figure 5:
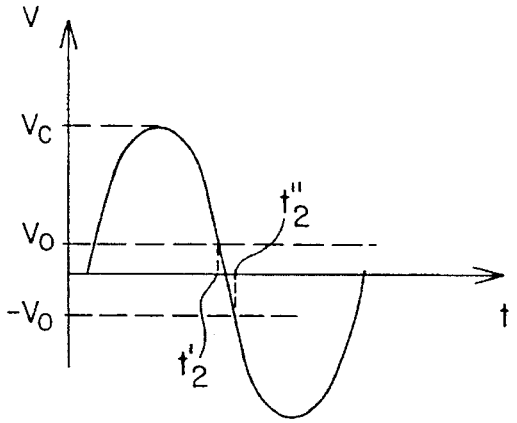

In a preferred embodiment, described below with reference to FIG. 4, the constraints affecting electromechanical switch 122 can be reduced even further. In this embodiment, signal processor 11 analyzes the wave form of voltage $V=V_b-V_A$ at the terminals of switch assembly 12. When the voltage output by the main circuit is a sinusoidal voltage, voltage $V=V_b-V_A$ has the same form, and during the intervals between $T_2$ and $T_1$ on the one hand, and $T_3$ and $T_4$ on the other, it varies between $+V_C$ and $-V_C$.

Ideally the signal processor 11 uses the result of its analysis to trigger the opening and closing of semiconductor switch 121 at instant $T_2$ and $T_3$ during instant in which voltage V passes through zero. In practice point $T_2$, for example, is positioned between instants $t'_2$ and $t''_2$ corresponding to voltages $V_0$ and $-V_0$, whose absolute value is substantially lower than the maximum voltage $V_C$ likely to be present between terminals A and B when semiconductor switch 121 is closed.

Thus, the electromechanical switch 122 only changes state when the absolute value of the voltage at its terminals is at most $V_0$ which is substantially lower than $V_C$.

This invention contemplates using various components from different origins. Good results have been obtained using a triac as semiconductor switch 121 and using the following components sold by SGS-THOMSON (registered trademark) for the signal processor 11 part numbers ST6, ST7, ST8 or ST9; for the modem 41 part numbers ST7536 or ST7537. The electromechanical switch 122 is preferably a mercury-contact relay.

In a preferred embodiment of the invention, the following conditions exist. If the voltage V of the main circuit is 200 V at 50 or 60 Hz, then the voltage $V_C$ is in the range 1.2 V to 1.7 V and the voltage $V_e$ is approximately 100 mV. The time interval between $T_2$ and $T_1$ is equal to 100 to 200 μs. The time interval between $T_3$ an $T_4$ is equal to 100 to 200 μs.

Having thus described one particular embodiment of the invention, various alterations, modifications, and improvements will readily occur to those skilled in the art. Such alterations, modifications, and improvements are intended to be part of this disclosure, and are intended to be within the spirit and scope of the invention. Accordingly, the foregoing description is by way of example only and is not intended as limiting. The invention is limited only as defined in the following claims and equivalents thereto.

What is claimed is:

1. An electric power switch connected to a main power circuit having a power line that provides a power signal and a command signal, the electric power switch comprising:

a modem having a modem input coupled to the power line of the main power circuit that receives the power signal and the command signal, and a modem output that provides the command signal separated from the power signal;

a signal processor having a signal processor input coupled to the modem output that receives the command signal, and a signal processor output that provides a control signal according to the command signal;

a semiconductor switch including a semiconductor switch control input coupled to the signal processor output; and an electromechanical switch including an electromechanical switch control input coupled to the signal processor output, wherein the semiconductor and the electromechanical switches are connected in parallel and operate to couple and de-couple the power line to a load according to the control signal.

2. The electric power switch as recited in claim 1, wherein the power signal is an alternating voltage waveform; wherein the semiconductor and the electromechanical switches are each coupled to a first terminal connected to the power line of the main power circuit, and a second terminal connected to the load; and wherein the signal processor activates and deactivates the electromechanical switch when a voltage difference between the first and the second terminals is between a first threshold voltage and a second threshold voltage.

3. The electric power switch as claimed in claim 1, wherein the semiconductor switch is a triac.

4. The electric power switch as claimed in claim 1, wherein the electromechanical switch is a mercury-contact relay.

5. The electric power switch as claimed in claim 1, further comprising:

a low-voltage regulator including an input coupled to the power line of the main power circuit, and an output that outputs a regulated supply voltage signal, wherein the signal processor further includes a supply voltage input coupled to the output of the low-voltage regulator that receives the regulated supply voltage signal.

6. The electric power switch as claimed in claim 1, wherein the command signal is generated and output by a remote control element coupled to the main power circuit.

7. The electric power switch as claimed in claim 1, wherein the command signal is modulated, and wherein the modem includes demodulation circuitry that demodulates the modulated command signal and outputs the command signal to the signal processor.

8. The electric power switch as claimed in claim 7, wherein:

the signal processor generates and outputs a return signal indicating that the command signal has been executed; and the modem, responsive to the return signal, modulates the return signal to form a modulated return signal and outputs the modulated return signal to the main power circuit.

9. The electric power switch as claimed in claim 1, wherein the command signal is generated and output by a local control element.

10. A method for coupling and de-coupling a power line of a main power circuit to a load, the power line having a power signal and a command signal, the method comprising the steps of:

receiving the power and the command signals from the power line of the main power circuit, and separating the power signal and the command signal;

closing a semiconductor switch and an electromechanical switch, when the command signal includes a first command, the semiconductor switch being closed before the electromechanical switch is closed; and opening the electromechanical switch and the semiconductor switch, when the command signal includes a second command, the electromechanical switch being opened before the semiconductor switch is opened.

11. The method of claim 10, wherein the semiconductor and the electromechanical switches are connected in parallel between the power line of the main power circuit and the load, wherein the power signal is an alternating voltage waveform, and wherein the steps of opening and closing include opening and closing, respectively, the electromechanical switch when the alternating voltage waveform is between a first threshold voltage and a second threshold voltage.

12. An electric power switch coupled to a main power circuit having a power line that provides a power signal and a command signal, the electric power switch comprising:

means, coupled to the power line of the main power circuit, for receiving the power signal and the command signal, separating the command signal from the power signal, and outputting a control signal according to separated command signal;

first switching means for making and breaking a first connection between a first terminal connected to the power line and a second terminal connected to a load, the first switching means including a control terminal coupled to an output of the means for receiving, separating and outputting; and second switching means for making and breaking a second connection between the first and the second terminals, the second switching means including a control terminal coupled to the output of the means for receiving, separating and outputting.

13. The electric power switch as claimed in claim 12, wherein the power signal is an alternating voltage waveform; and wherein the means for receiving, separating and outputting activates and deactivates the second switching means when a voltage difference between the first and the second output terminals is between a first threshold voltage and a second threshold voltage.

14. The electric power switch as claimed in claim 12, wherein said first switching means is a triac.

15. The electric power switch as claimed in claim 12, wherein said second switching means is a mercury-contact relay.

16. The electric power switch as claimed in claim 12, further comprising:

means, coupled to the power line of the main power circuit, for regulating the power signal to output a regulated voltage, wherein an input of the means for receiving, separating and outputting is coupled to an output of the means for regulating.

17. The electric power switch as claimed in claim 12, wherein the command signal is generated and output by a control device.

18. The electric power switch as claimed in claim 17, wherein the control device is a remote control element coupled to the main power circuit.

19. The electric power switch as claimed in claim 17, wherein the control device is a local control unit.

20. The electric power switch as claimed in claim 12, wherein the command signal is modulated, and wherein the means for receiving, separating and outputting includes means for demodulating the modulated command signal.

21. The electric power switch as claimed in claim 20, further comprising:

means for generating a return signal indicating that the command signal has been executed; and means, responsive to the return signal, for modulating the return signal to form a modulated return signal and outputting the modulated return signal to the main power circuit.

22. A method for coupling and de-coupling a power line of a main power circuit to a load, the power line having a power signal and a command signal, the method comprising the steps of:

receiving the power and the command signals from the power line of the main power circuit, and separating the power signal and the command signal;

closing first switching means and second switching means, when the command signal includes a first command, the first switch means being closed before the second switch means is closed; and opening the second switching means and the first switching means, when the command signal includes a second command, the second switching means being opened before the first switching means is opened.

23. The method of claim 22, wherein the first and the second switching means are coupled in parallel between the power line of the main power circuit and the load, wherein the power signal is an alternating voltage waveform, and wherein the steps of opening and closing include opening and closing, respectively, the second switching means when the alternating voltage waveform is between a first threshold voltage and a second threshold voltage.

* * * * *